US007140224B2

(12) United States Patent
Luo et al.

(10) Patent No.: US 7,140,224 B2
(45) Date of Patent: Nov. 28, 2006

(54) MODERATE TEMPERATURE BENDING OF MAGNESIUM ALLOY TUBES

(75) Inventors: Aihua A Luo, Troy, MI (US); Anil K Sachdev, Rochester, MI (US)

(73) Assignee: General Motors Corporation, Detroit, MI (US)

( * ) Notice: Subject to any disclaimer, the term of this patent is extended or adjusted under 35 U.S.C. 154(b) by 208 days.

(21) Appl. No.: 10/793,487

(22) Filed: Mar. 4, 2004

(65) Prior Publication Data

US 2005/0194074 A1 Sep. 8, 2005

(51) Int. Cl.
*B21D 9/00* (2006.01)

(52) U.S. Cl. ..... 72/369; 72/150; 72/342.94; 72/700

(58) Field of Classification Search ..... 72/58, 72/61, 149, 150, 342.1, 342.7, 342.8, 342.74, 72/369, 700; 148/570, 667
See application file for complete search history.

(56) References Cited

U.S. PATENT DOCUMENTS 2,378,729 A * 6/1945 Schmidt ..... 72/274
2,934,462 A 4/1960 Barbian et al.
4,006,621 A * 2/1977 Moshnin et al. ..... 72/151
4,239,535 A 12/1980 King et al.
4,380,917 A * 4/1983 Uchida et al. ..... 72/17.2
4,481,803 A * 11/1984 Dieser ..... 72/150
5,078,806 A 1/1992 Das et al.
5,250,124 A 10/1993 Yamaguchi et al.
5,348,591 A 9/1994 Masumoto et al.
5,728,239 A 3/1998 Setzer et al.
5,787,585 A 8/1998 Rashid
5,895,518 A 4/1999 Guthrie et al.
6,067,831 A * 5/2000 Amborn et al. ..... 72/58
6,328,657 B1 * 12/2001 Kitagawa et al. ..... 470/17
6,544,357 B1 4/2003 Hehmann et al.
6,767,650 B1 * 7/2004 Hausberger et al. ..... 428/598
6,921,444 B1 * 7/2005 Joaquin et al. ..... 148/570
2003/0000608 A1 1/2003 Horie et al.

* cited by examiner

*Primary Examiner*—Ed Tolan
(74) *Attorney, Agent, or Firm*—Kathryn A. Marra

(57) ABSTRACT

A method for bending magnesium alloy tubes. The method includes heating the tube at moderate temperature in the range of about 100° C. to 200° C., and bending the tube to a bend angle or forming the tube to a desired shape.

23 Claims, 11 Drawing Sheets

MODERATE TEMPERATURE BENDING OF MAGNESIUM ALLOY TUBES

FIELD OF THE INVENTION

This invention relates to forming magnesium alloy structures, and more particularly to forming magnesium alloy tubes.

BACKGROUND OF THE INVENTION

Weight reduction for automobile fuel economy has spurred the growth of magnesium consumption over the last decade at an annual rate of 15%. To date, the automotive applications of magnesium have been die castings, because of the high productivity of the die casting process. To maintain the competitiveness of current magnesium components, and further expand to new applications, improved wrought magnesium alloys and manufacturing processes for such alloys are needed.

Currently, magnesium and its known alloys have poor bendability and formability except in the usual working temperature range for magnesium alloys of 260° C.–320° C., which is the temperature range for conventional "warm" forming of sheet product.

To expand the applicability of magnesium alloys to additional components and structures of a vehicle, improved methods of working magnesium alloys at less cost and without compromising quality are desirable.

SUMMARY

The present teachings provide a method for bending magnesium alloy tubes. The method includes heating a tube at moderate temperatures in the range of about 100° C. to 200° C., and bending the tube to a bend angle, or forming the tube to a desired shape.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION OF VARIOUS EMBODIMENTS

The following description of various embodiments is merely exemplary in nature and is in no way intended to limit the invention, its application, or uses.

The present invention provides a method for moderate temperature bending of magnesium alloy tubes. Moderate temperature bending is defined as bending at temperatures less than 260° C. and more specifically in the range of 100° C. to 200°. This is an unexpected result in view of "warm" temperature bending, which involves temperatures in the range of 260° C.–320° C. for sheet product, and not tubes. The tubes can be made from any magnesium alloy that has magnesium content greater than 80% magnesium.

Figure 1:
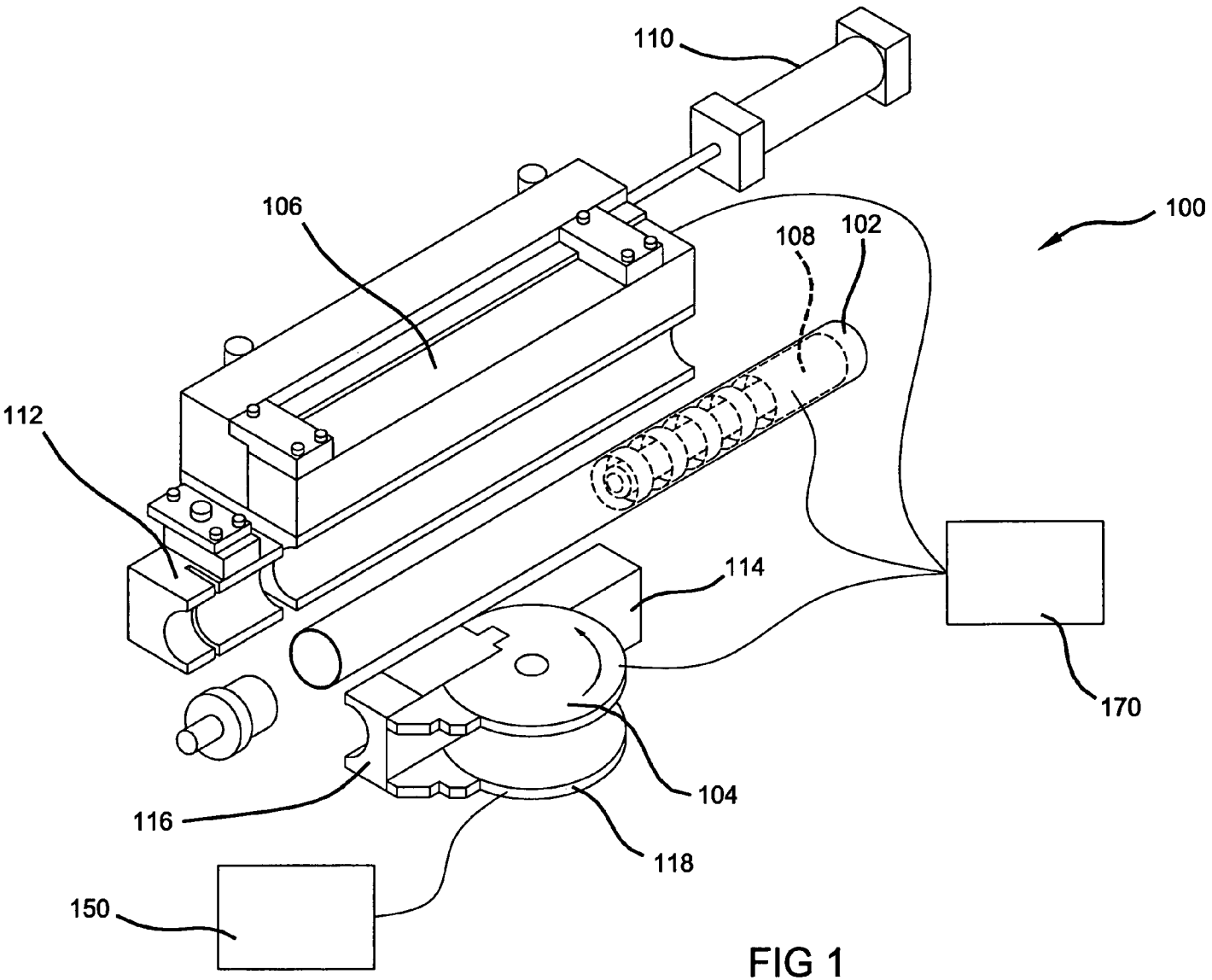
FIG. 1 is a partially perspective view of a system for bending magnesium alloy tubes according to the present teachings.
Figure 2:
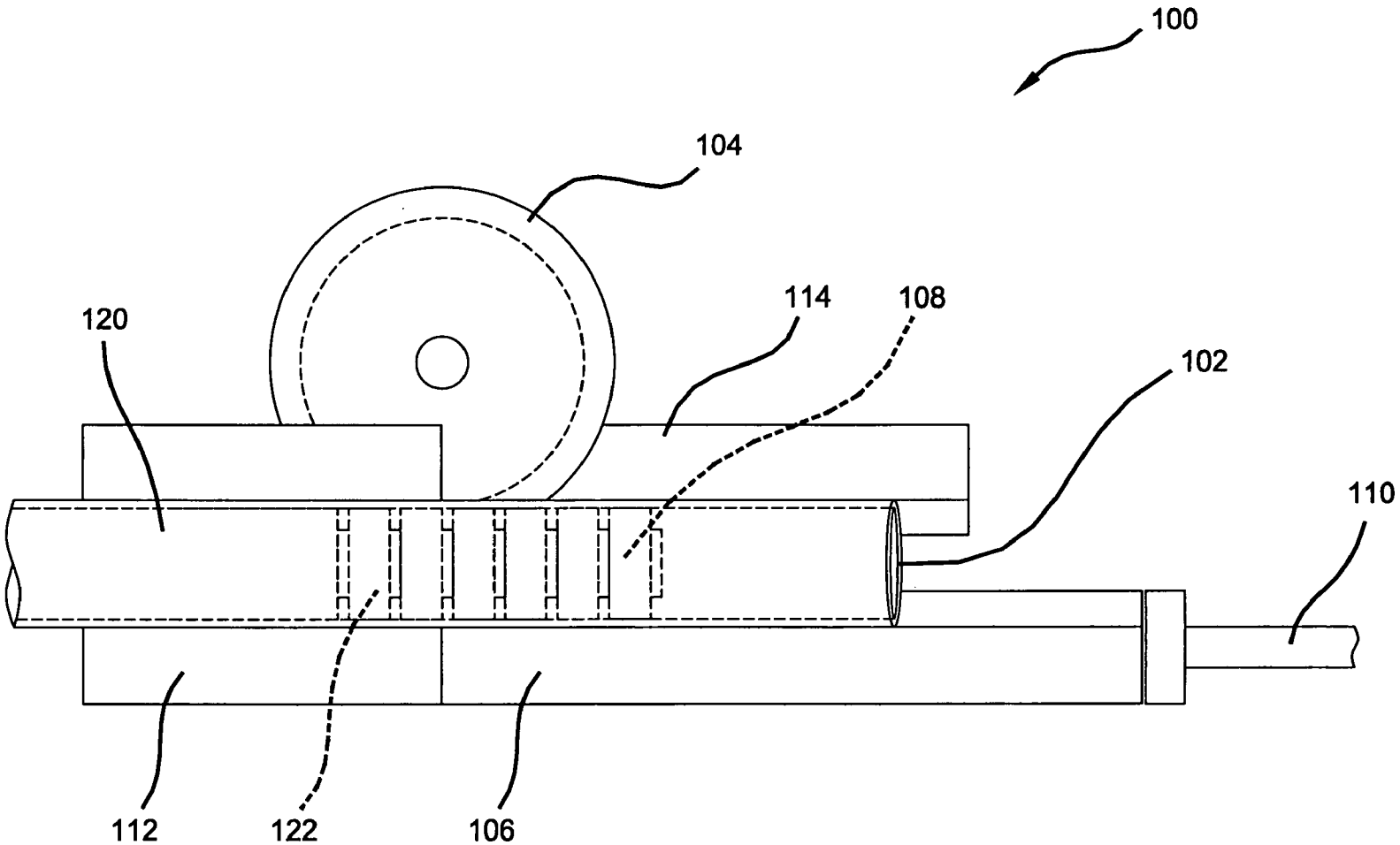
FIG. 2 is a plan view of a system for bending magnesium alloy tubes according to the present teachings.

A system 100 for bending a magnesium alloy tube 102 is illustrated schematically in FIGS. 1 and 2. Although a rotary draw bending system is illustrated in FIGS. 1 and 2, the present teachings are not limited to the use of a rotary draw system, and other bending systems, such as hydroforming, roll bending, compression-type bending, press-type bending systems, etc., can also be used.

The bending system 100 includes a bend die 104, a pressure die 106, and a mandrel 108. The system 100 may also include a pressure die boost cylinder 110, a clamp die 112, and a wiper die 114. The bend die 104 is a forming tool which is used to make a specific radius of bend. The bend die 104 generally includes an insert portion 116 and a bend radius portion 118. The insert portion 116 is used for clamping the tube 102 to the bend die 104 before forming. The bend radius portion 118 forms the arc of the bend as the tube 102 is drawn around the die. The bend die 104 is connected to a bender 150 that controls rotation of the bend die 104.

The clamp die 112 works in conjunction with the bend die 104 to clamp the tube 102 to the bend die 104. The clamp die 112 can be moved to allow feeding of the tube 102. The pressure die 106 is used to press the tube 102 into the bend die 104 and provide reaction force for bending the tube 102. The pressure die 106 travels with the tube 102 as the tube 102 is being formed. The pressure die boost cylinder 110 is attached to the pressure die 106. The pressure die boost cylinder 110 can assist the tube 102 through the bend to prevent tube breakage, wall thinning and ovality.

The mandrel 108 is used inside the tube 102 to keep the tube 102 round during bending. Depending on the wall thickness of the tube 102, a plug mandrel 108 having a shank 120, or a segmented ball type mandrel 108 having a shank 120 and mandrel balls 122 can be used. The mandrel balls 122 are beneficial when bending thin wall tubes 102 to prevent the tubes 102 from collapsing about the bend. A wiper die 114 can sometimes be used to prevent wrinkling of the tube 102. The wiper die 114 is mounted behind the bend die 104.

A tooling temperature controller 170 is provided to allow control of the temperature of the tooling, which includes the bend die 104, the pressure die 106, the mandrel 108, and other tooling components, as desired. In operation, the tooling is pre-heated to the desired temperature and the tube 102 is positioned on the system 100. The clamp die 112 grips the tube 102 between the clamp die 112 and the bend die 104. The mandrel 108 advances to the correct position inside the tube 102. The tube 102 can be held in this position for a period of time, typically between one to five minutes, for the tube 102 to acquire the desired moderate temperature for forming. Then the clamp die 112 and bend die 14 rotate and draw the tube 102 around the bend, while the pressure die 106 advances forward. The mandrel 108 is withdrawn and the clamp die 112 opens to release the bent tube 102.

Bending the magnesium alloy tubes 102 at moderate temperatures according to the present teachings as described above provides unexpectedly significant improvements in bendability in comparison to room temperature bending. Heretofore, bending of magnesium alloy tubes has been conducted at near room temperature, on the order of 15° C. to 25° C. (about 60° F. to 80° F.). The quality of the tube product and degree of bending formed at room temperature is poor. Although warm forming of magnesium alloy sheet stock at 260° C. to 300° C. and superplastic forming (SPF) of magnesium alloy sheet stock at 300° C. to 500° C. are known processes, these processes are more complicated and costlier than room temperature forming and have not been used for tube forming. Therefore, it is unexpected to form tube stock at any temperature other than room temperature. Bending of magnesium alloy tube stock to tight radii at room temperature is not practical.

The present invention overcomes current obstacles to tube bending quality and cost effective manufacturing. Magnesium and its alloys have poor bendability and formability at room temperature because the hexagonal lattice structure of magnesium only allows basal slip at temperatures below about 220° C. Above this temperature, slip on twelve pyramidal planes is also possible, and magnesium alloys can be readily worked. Unexpectedly, the present invention provides good quality bend tube product at a moderate temperature range well above room temperature and well below sheet forming temperature.

A bend radius as low as two times the outer diameter (OD) of the tube 102, referred as bend radius 2D, can be achieved at temperatures as low as 120° C. for magnesium alloy tubes. Compared to conventional warm forming or superplastic forming at higher temperatures, moderate temperature bending provides better dimensional accuracy because of less thermal expansion and distortion during cooling to room temperature. Additionally, the moderate temperature bending of the present teachings requires less tooling and simpler process control resulting in significant cost savings.

The present teachings of moderate temperature bending of magnesium alloy tubes were tested for experimental purposes at Woolf Aircraft Product, Inc., in Romulus, Mich., on a Pines rotary draw hot bending machine. Specifically, two magnesium extrusion alloys, AM30 and AZ31B, were selected for the experimental testing of the moderate temperature bending process. AZ31B offers a good combination of mechanical properties and is presently the most widely used commercial extrusion alloy. AM30 is a new magnesium wrought alloy, which is described in a co-owned and concurrently filed U.S. patent application entitled "Magnesium Extrusion Alloy Having Improved Extrudability And Formability", the entire disclosure of which is incorporated by reference herein. The concurrently filed application discloses a magnesium based alloy that generally comprises aluminum (Al) from about 2.5 to about 3.5 weight %; manganese (Mn) from about 0.2 to 0.6 weight %; zinc (Zn) less than about 0.22 weight %; one or more impurities of less than about 0.1 weight %; and a balance of magnesium (Mg). The specific chemical compositions of the two magnesium alloys that were tested are shown in Table 1 (the balance is magnesium (Mg).

TABLE 1

Chemical Composition of AM30 and AZ31B (in wt. %)

| Alloy | Al | Mn | Zn | Fe | Ni | Cu |
|---|---|---|---|---|---|---|
| AM30 | 3.4 | 0.33 | 0.16 | 0.0026 | 0.0006 | 0.0008 |
| AZ31B | 3.1 | 0.54 | 1.05 | 0.0035 | 0.0007 | 0.0008 |

Figure 3:
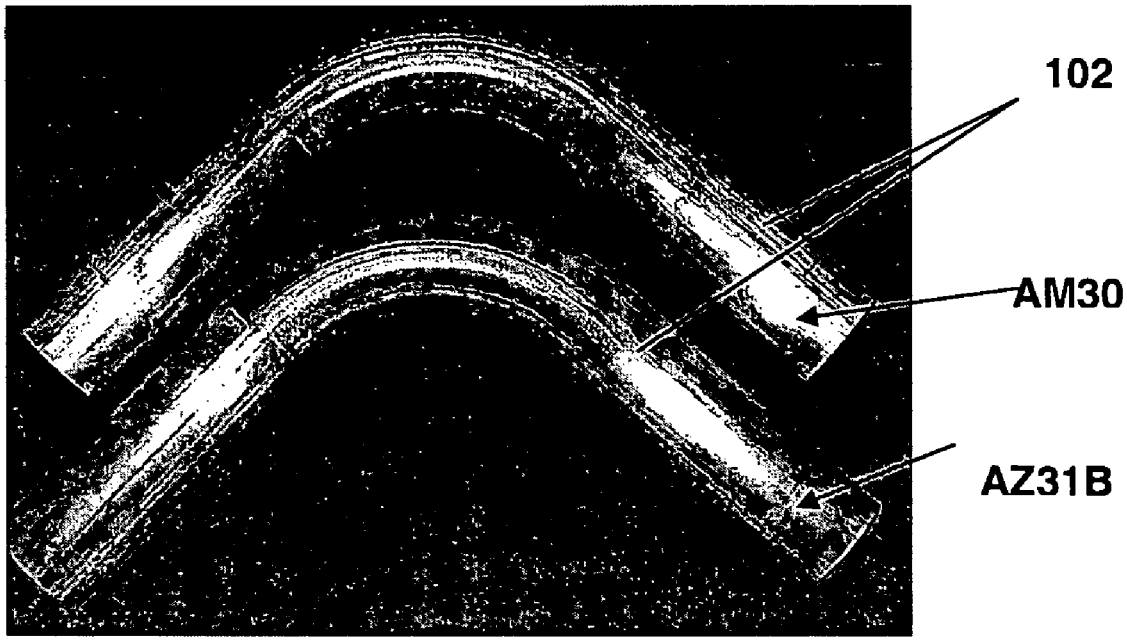
FIG. 3 is a perspective view of AM30 and AZ31B alloy bent tubes according to the present teachings.

In the experimental tests, each tube 102 has a nominal outside diameter of 70 mm and a nominal thickness of 4 mm. All tubes 102 are cut to a length of 635 mm for the bending experiments. The centerline radius is 140 mm for all tubes bent in this study, and resulted in a 2D bend for 70 mm OD (outside diameter) tubes, as is generally desirable for automotive tubular components. FIG. 3 illustrates AM30 and AZ31B bent tubes 102 with a 2D bend radius and a 90° bend angle. The mandrel 108, pressure die 106 and bend die 104 of the tooling were pre-heated to a desired temperature for each bending experiment. After the tooling reached a steady state condition, a tube 102 (not pre-heated) was placed over the steel multi-ball mandrel 108, and enclosed between the pressure die 106 and the bend die 104. Bending experiments were conducted at a temperature range of 250° F.–400° F. (about 120° C.–200° C.), based on the tensile properties of the alloys. The tube temperature was monitored by the tooling temperature controller 170 and it was found that it could reach the tooling temperature in about one minute. However, to ensure good temperature equilibrium, the tube 102 was kept in the heated tooling for 5 minutes before bending to 90° in this study. For all experiments, the clamp die pressure was fixed to provide the best clamp without tube slippage.

Figure 4:
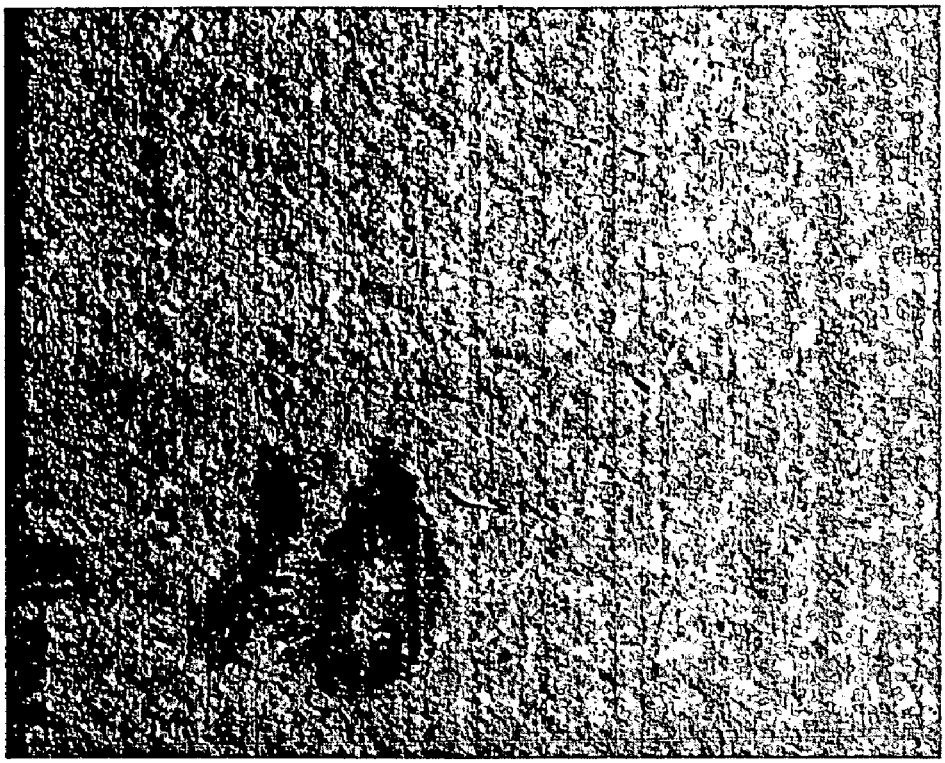
FIG. 4 is an exemplary surface appearance of a bent AM30 alloy tube with surface defect rating of 4 according to the present teachings.
Figure 5:
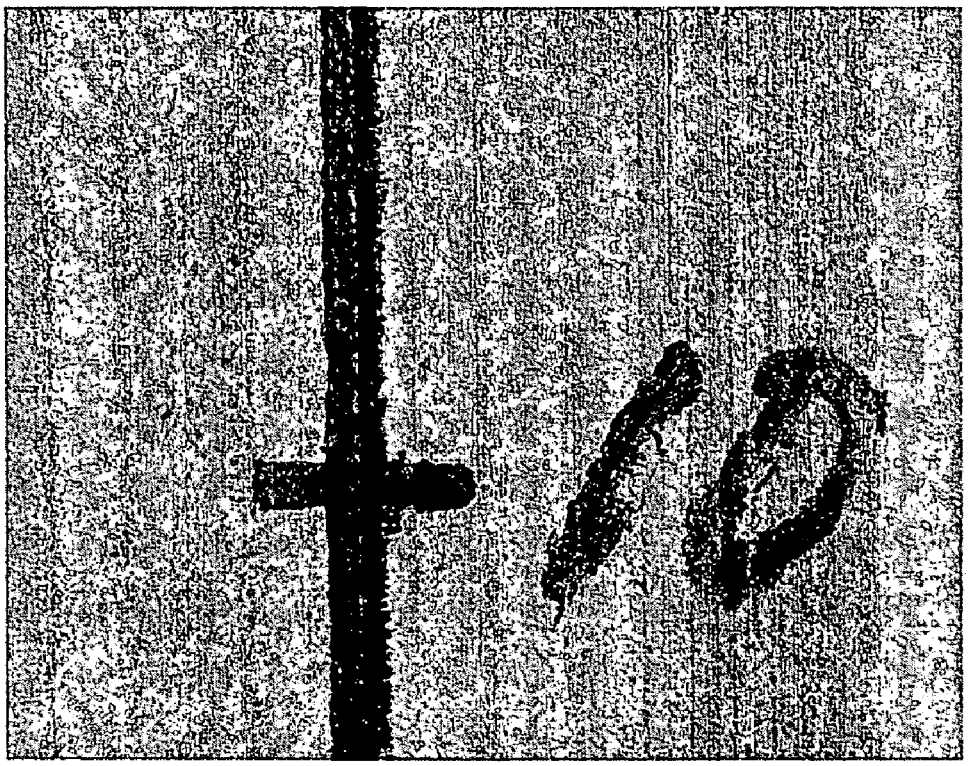
FIG. 5 is an exemplary surface appearance of a bent AZ31B alloy tube with surface defect rating of 2 according to the present teachings.

To evaluate the quality of the bent tubes 102, parameters quantifying surface defects, maximum thinning and standard deviation of thinning were measured. Surface defects were evaluated under a microscope to check for roughness and scaling. For each tube 102, six areas along the tension side of the bend were checked and a rating of 1 to 5 (with 1 corresponding to the least defects and 5 corresponding to the most defects) was assigned to each area and an average was obtained for the tube 102. FIGS. 4 and 5 show examples of such images for AM30 and AZ31B alloy tubes 102, respectively.

Figure 6:
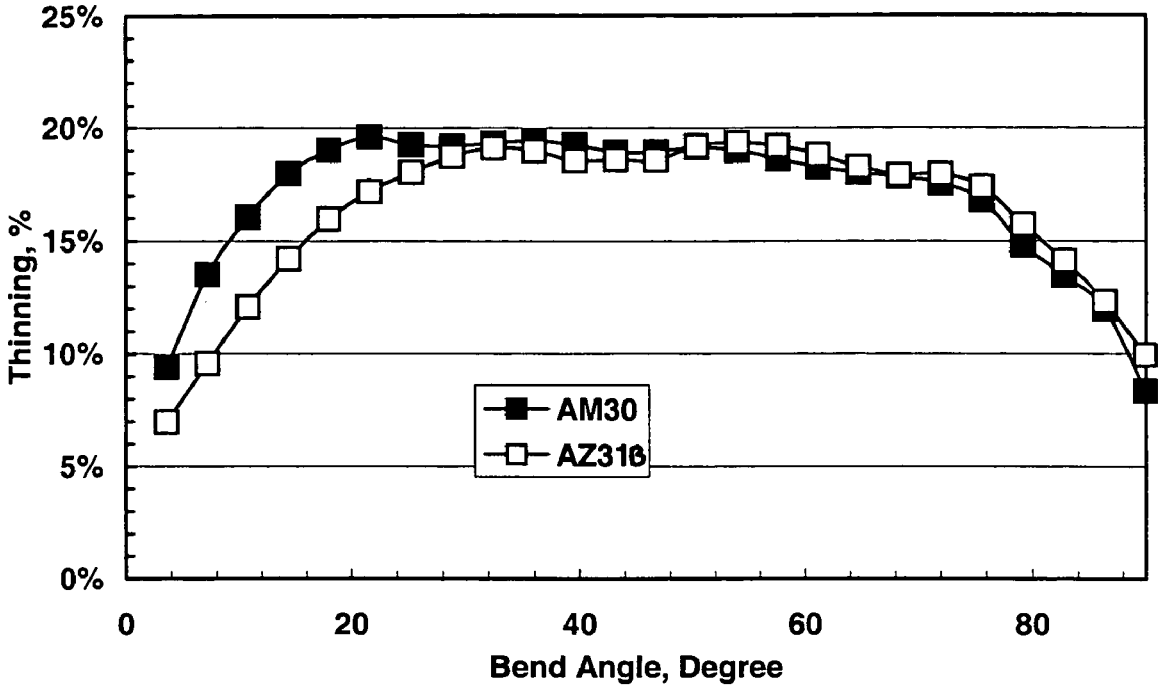
FIG. 6 is a graph showing thinning distribution in tubes bent at 300° F. (149° C.) according to the present teachings.

Maximum thinning was measured using an ultrasonic thickness gage along the tension side of the bent tubes 102. FIG. 6 shows exemplary results where the maximum thinning was measured at about 20%. The standard deviation of thinning was also obtained from the thinning distribution curves of FIG. 6, in order to assess the thinning uniformity in bent tubes 102. Additionally, the surface, longitudinal, and transverse sections of the magnesium alloy tubes were mounted, polished, and etched for microstructural analysis. Optical microscopy was used to examine the grain structure of both magnesium alloys, AM3O and AZ31B, before and after bending.

The experimental results of the bend tests are shown in Table 2. For each test, the alloy used for the tubes 102, the temperature of the tooling, the type of lubricant used (Stawdraw or Ameriform), the pressure die pressure, and whether a wiper die 114 was used is shown, together with the corresponding parameters of surface defect rating, maximum percent thinning and standard deviation of percent thinning.

TABLE 2

Experimental Results

| Exp. # | Temp. ° F.(° C.) | Alloy | Lube | Pressure Die Pressure ft. lb | Wiper Die | Surface Defect Rating | Max. % Thinning | Standard Deviation Of % Thinning |
|---|---|---|---|---|---|---|---|---|
| 1 | 250 (121) | AZ31B | Stawdraw | 30 | Yes | 2.12 | 21.07 | 4.14 |
| 2 | 350 (177) | AM30 | Stawdraw | 20 | Yes | 3.34 | 21.49 | 3.39 |
| 3 | 300 (149) | AM30 | Stawdraw | 30 | No | 3.37 | 20.64 | 4.03 |
| 4 | 400 (204) | AZ31B | Stawdraw | 20 | No | 1.92 | 25.91 | 5.08 |
| 5 | 250 (121) | AM30 | Ameriform | 20 | No | 4.19 | 19.62 | 4.00 |
| 6 | 350 (177) | AZ31B | Ameriform | 30 | No | 1.24 | 20.81 | 4.38 |
| 7 | 300 (149) | AZ31B | Ameriform | 20 | Yes | 1.44 | 21.01 | 3.67 |
| 8 | 400 (204) | AM30 | Ameriform | 30 | Yes | 4.22 | 20.48 | 4.12 |

Variance analysis was used to evaluate the effect of all factors on each parameter and the results are summarized in Table 3. Variance analysis was done by summing up each parameter at the same level for each factor. For instance, all surface defects ratings were summed for all tests run at 250° F. (121° C.); and then for all runs at 300° F. (149° C.), 350° F. (177° C.) and 400° F. (204° C.). The maximum difference among these levels is defined as the level "variance".

TABLE 3

Variance Analysis

| Factor | Level | Surface Defects | Maximum % Thinning | Standard Deviation on % Thinning |
|---|---|---|---|---|
| Temperature F. °/C. ° | 250 (121) | 6.31 | 40.7 | 8.14 |
| | 300 (149) | 4.57 | 42.3 | 7.77 |
| | 350 (177) | 4.81 | 41.65 | 7.7 |
| | 400 (204) | 6.14 | 46.39 | 9.2 |
| | Variance | 1.74 | 5.69 | 1.5 |
| Alloy | AM30 | 15.11 | 82.23 | 15.54 |
| | AZ31B | 6.72 | 88.8 | 17.27 |
| | Variance | 8.39 | 6.57 | 1.73 |
| Lube | Ameriform | 11.09 | 81.92 | 16.17 |
| | Woolf | 10.74 | 89.11 | 16.64 |
| | Variance | 0.35 | 7.19 | 0.47 |
| Pressure Die Pressure | 20 ft. lbs | 10.72 | 86.98 | 17.49 |
| | 30 ft. lbs | 11.11 | 84.05 | 15.32 |
| | Variance | 0.39 | 2.93 | 2.17 |
| Wiper Die | Yes | 10.95 | 83 | 16.67 |
| | No | 10.88 | 88.03 | 16.14 |
| | Variance | 0.07 | 5.03 | 0.53 |

Figure 7:
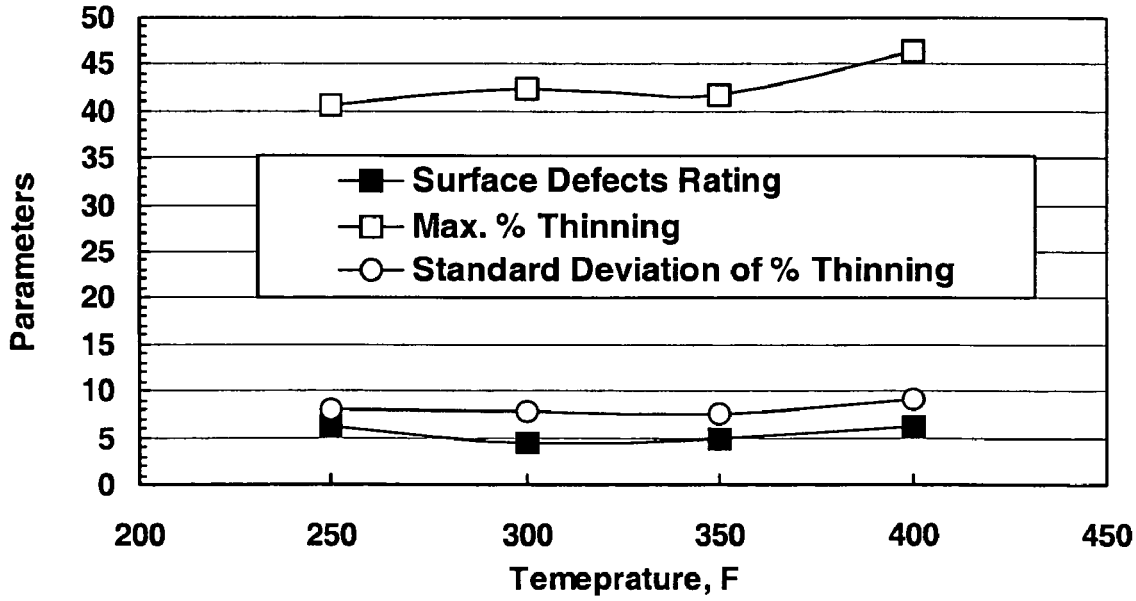
FIG. 7 is a graph showing the effect of test temperature on measured parameters according to the present teachings.
Figure 8A:
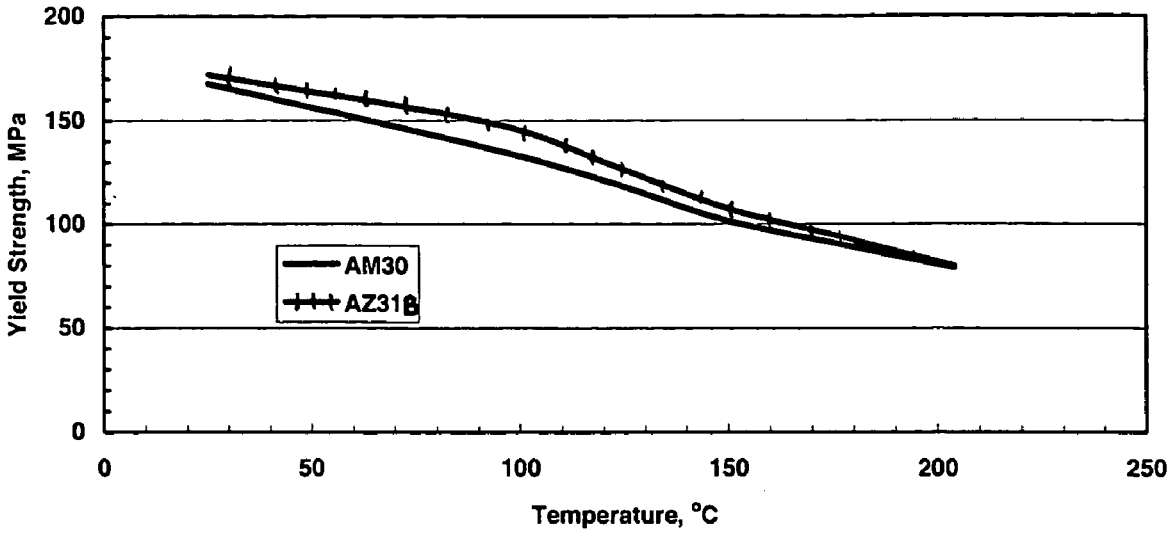
FIGS. 8(*a*)–(*c*) illustrate respectively the effect of temperature on yield strength, ultimate tensile strength and elongation of magnesium alloy tubes.
Figure 8B:
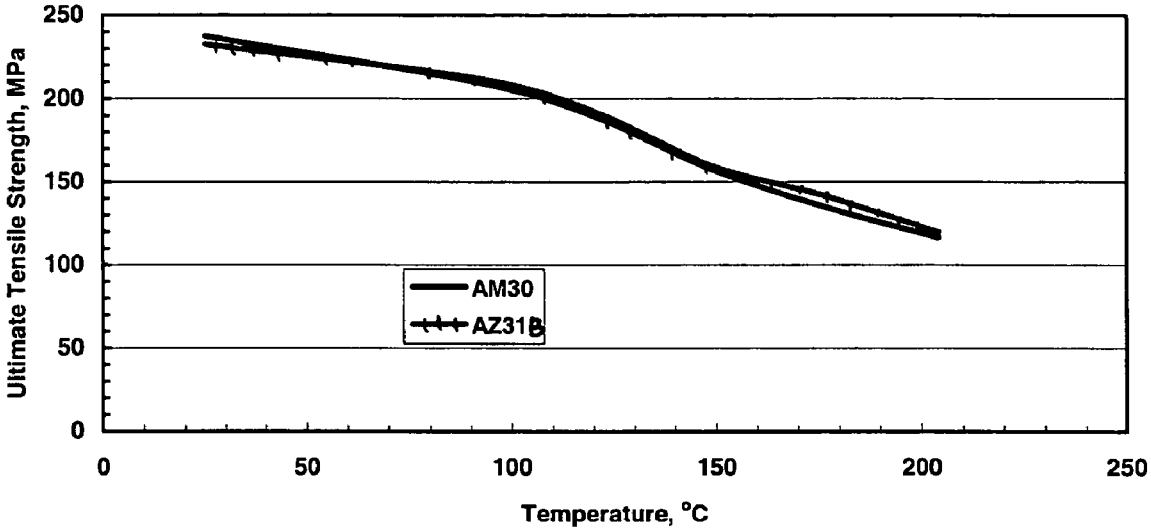
Figure 8C:
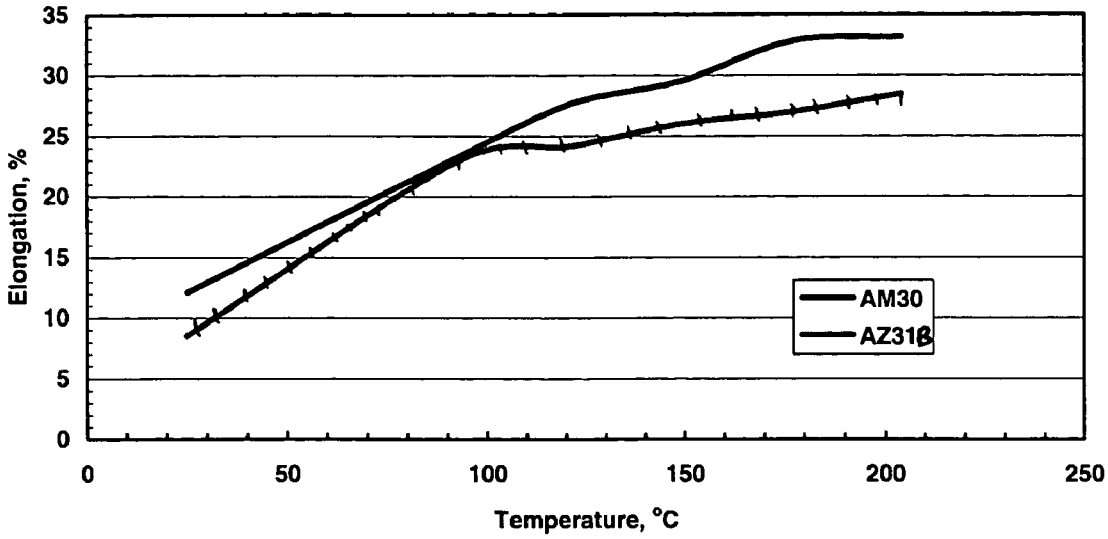

FIG. 7 illustrates that the test temperature has a significant effect on the bend quality. As temperature increases up to 350° F. (177° C.), the tube surface quality improves (lower defect rating) and the thinning is —more uniform (smaller maximum and standard deviation of the percentage thinning). However, the bend quality deteriorates at 400° F. (204° C.), i.e., there are more surface defects and less uniform thinning. According to FIG. 7 and Table 3, the temperature range of 300° F.–350° F. (149° C.–177° C.) appears to be the optimum temperature range for the magnesium alloy tube bending of the exemplary tests. A temperature of 300° F. (149° C.) was chosen for the confirmation tests because lower temperatures are easier to operate and more economical. In this regard, the tensile properties of AM30 and AZ31B alloys suggest that the alloy ductility does not change significantly at temperatures between 300° F. (149° C.) and 400° F. (204° C.), as shown in FIG. 8.

Figure 9:
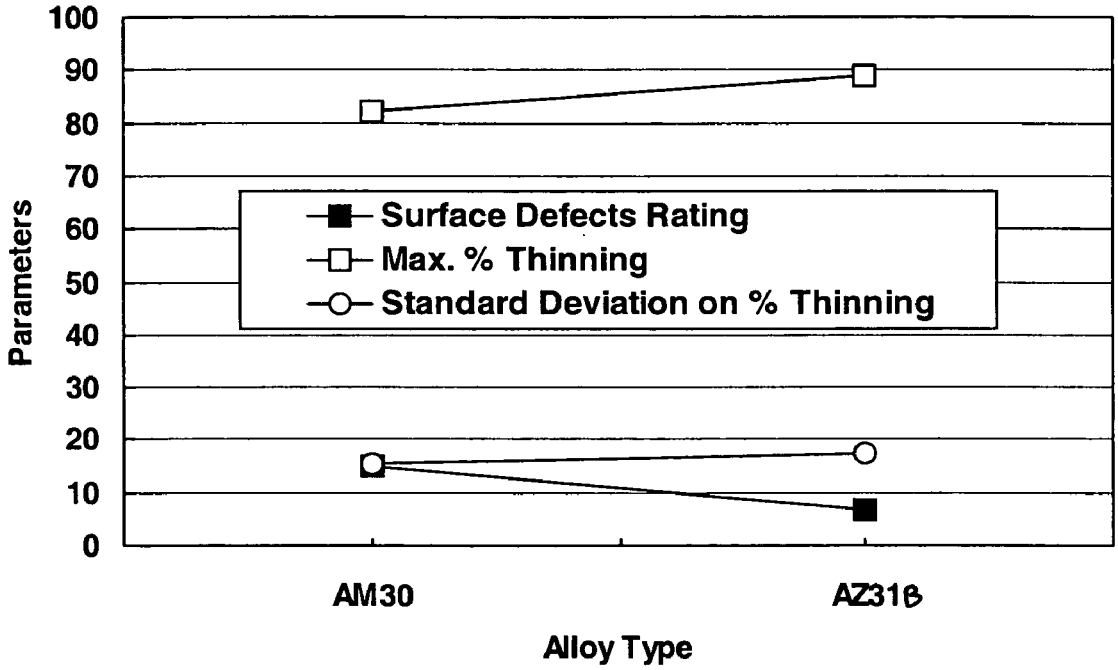
FIG. 9 is a graph illustrating the effect of alloy type on measured parameters according to the present teachings.
Figure 10:
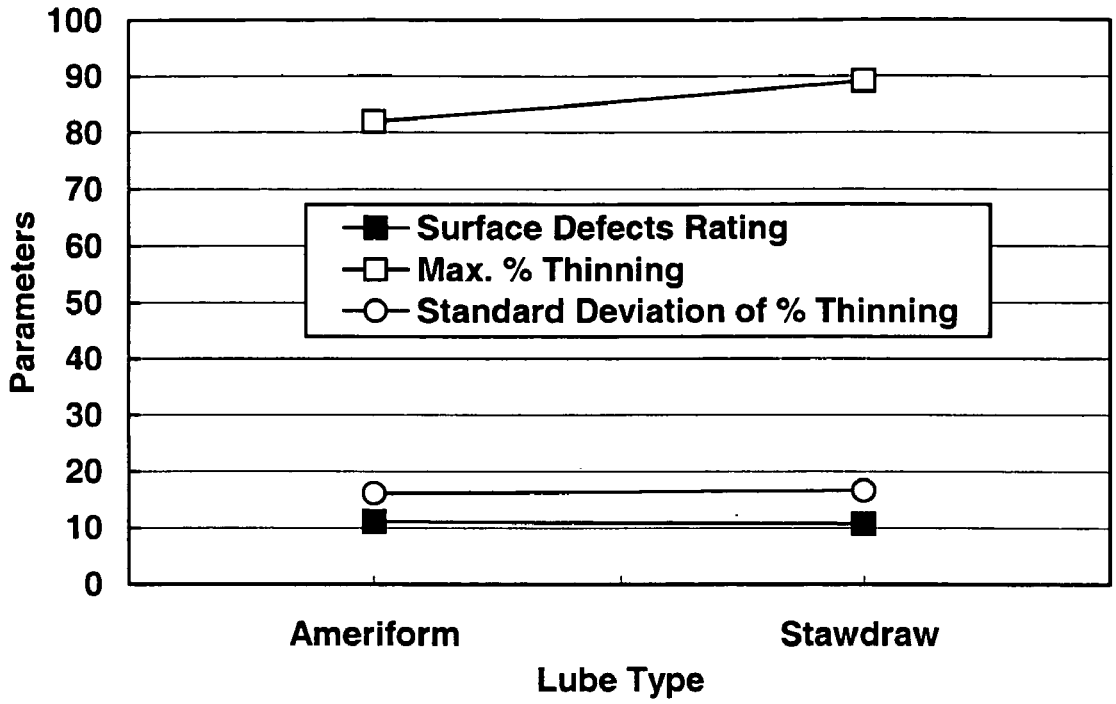
FIG. 10 is a graph illustrating the effect of lubricant type on measured parameters according to the present teachings.

The effect of alloy type on bend quality is illustrated in FIG. 9. FIG. 10 illustrates the effect of the lubricant type, which shows that the Ameriform dry-film lubricant provides much more uniform thinning than the Stawdraw oil-based lubricant. It was also observed that the Ameriform dry-film lubricant provided better heat conductivity between the tube 102 and tooling, which is beneficial for temperature control during bending. Therefore, the water-based Ameriform dry-film lubricant was selected in the confirmation tests.

Figure 11:
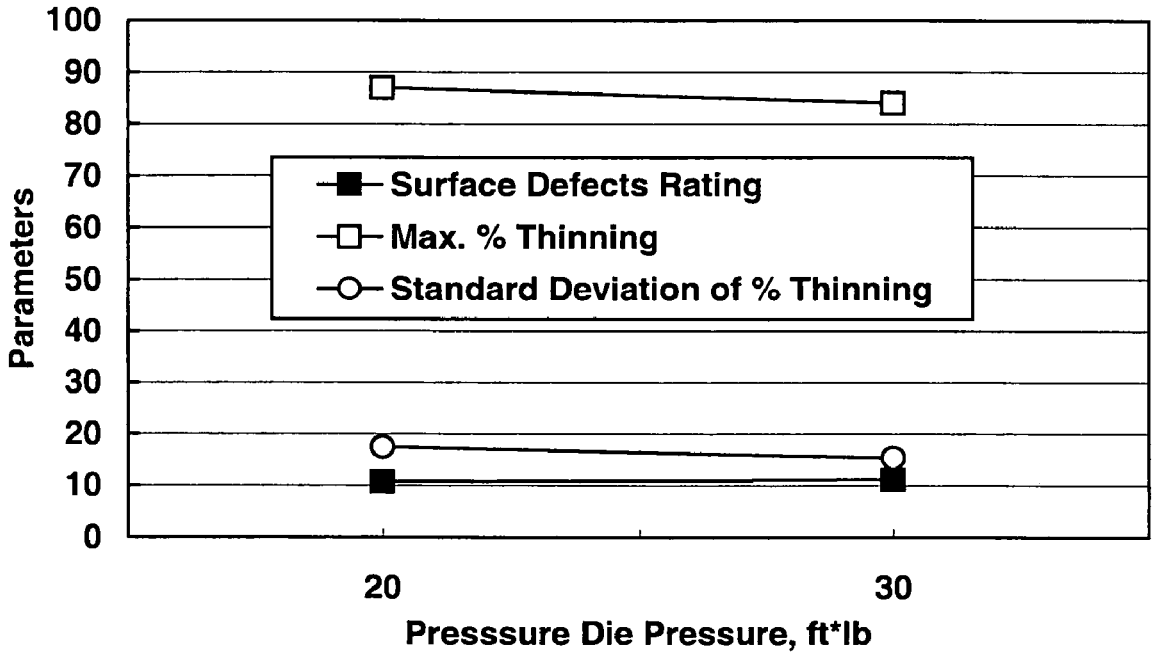
FIG. 11 is a graph illustrating the effect of pressure die pressure on measured parameters according to the present teachings.
Figure 12:
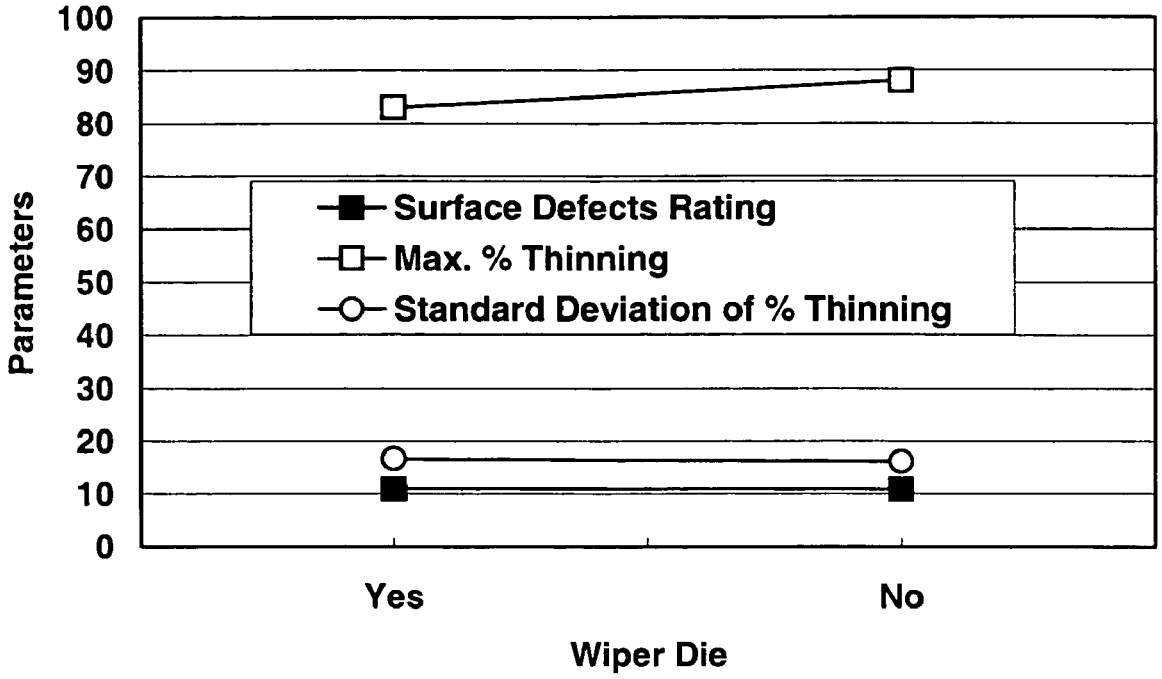
FIG. 12 is a graph illustrating the effect of wiper die on measured parameters according to the present teachings.

A pressure die pressure of 30 ft.lb produced more uniform thinning and was chosen over 20 ft.lb, as illustrated in FIG. 11. Finally, as shown in FIG. 12, the use of a wiper die 114 could reduce the maximum thinning, but has little effect on tube surface quality or thinning distribution. Therefore, the wiper die 114 was not chosen for the confirmation tests to reduce tooling cost and improve productivity. The wiper die 114 can be used for critical parts if desired.

Figure 13:
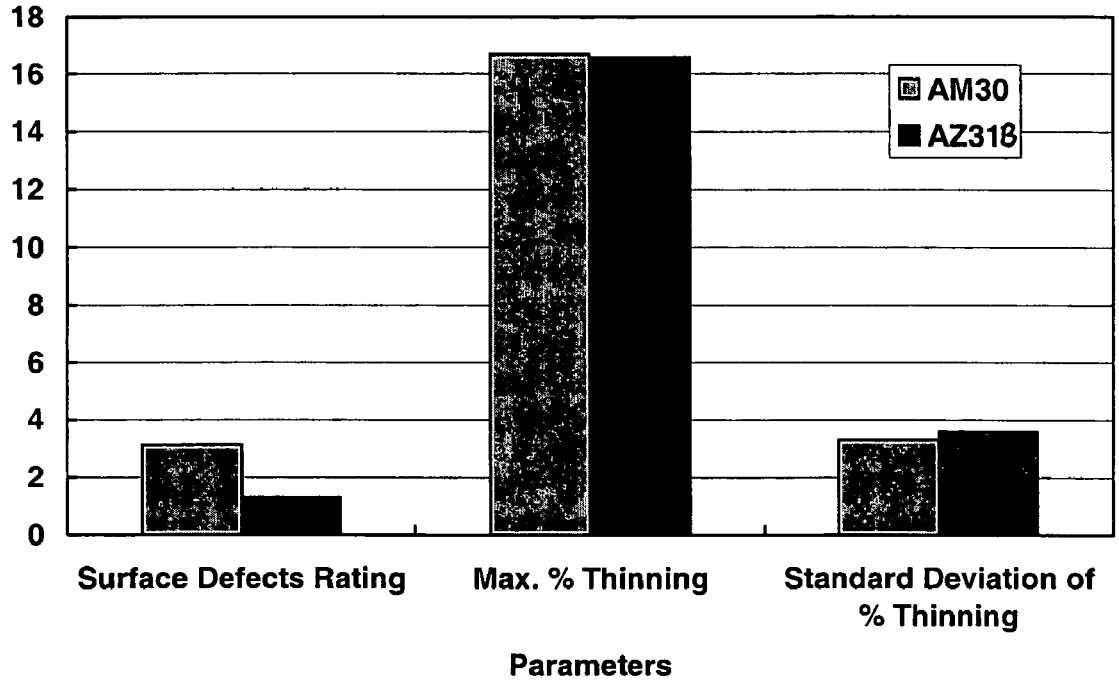
FIG. 13 is a comparative bar graph of measured parameters for AM30 and AZ31 B alloys according to the present teachings.

As determined by the variance analysis of Table 3, the optimum bending conditions for the exemplary magnesium tubes 102 tested are bending at temperature 300° F. (149° C.), use of Ameriform dry lubricant, no wiper die, and a pressure die pressure of 30 ft.lb. These conditions were verified in confirmation tests by bending five tubes 102 for each of the two alloys, AZ31B and AM30. FIG. 13 shows the results for the confirmation tests. Compared to the results of Table 2, both alloys show very uniform thinning distribution (very small maximum and standard deviation of the percentage thinning) in the confirmation tests. However, the AM30 alloy tubes 102 have more surface defects than AZ31B tubes. A closer examination of these defects indicates that they are mostly contained in the rough surface shown in FIG. 4. No surface cracks were detected in these tubes 102. These results confirm that the bending conditions used can produce good quality bends in both AZ31B and AM30 tubes, as shown in FIG. 3.

Figure 14:
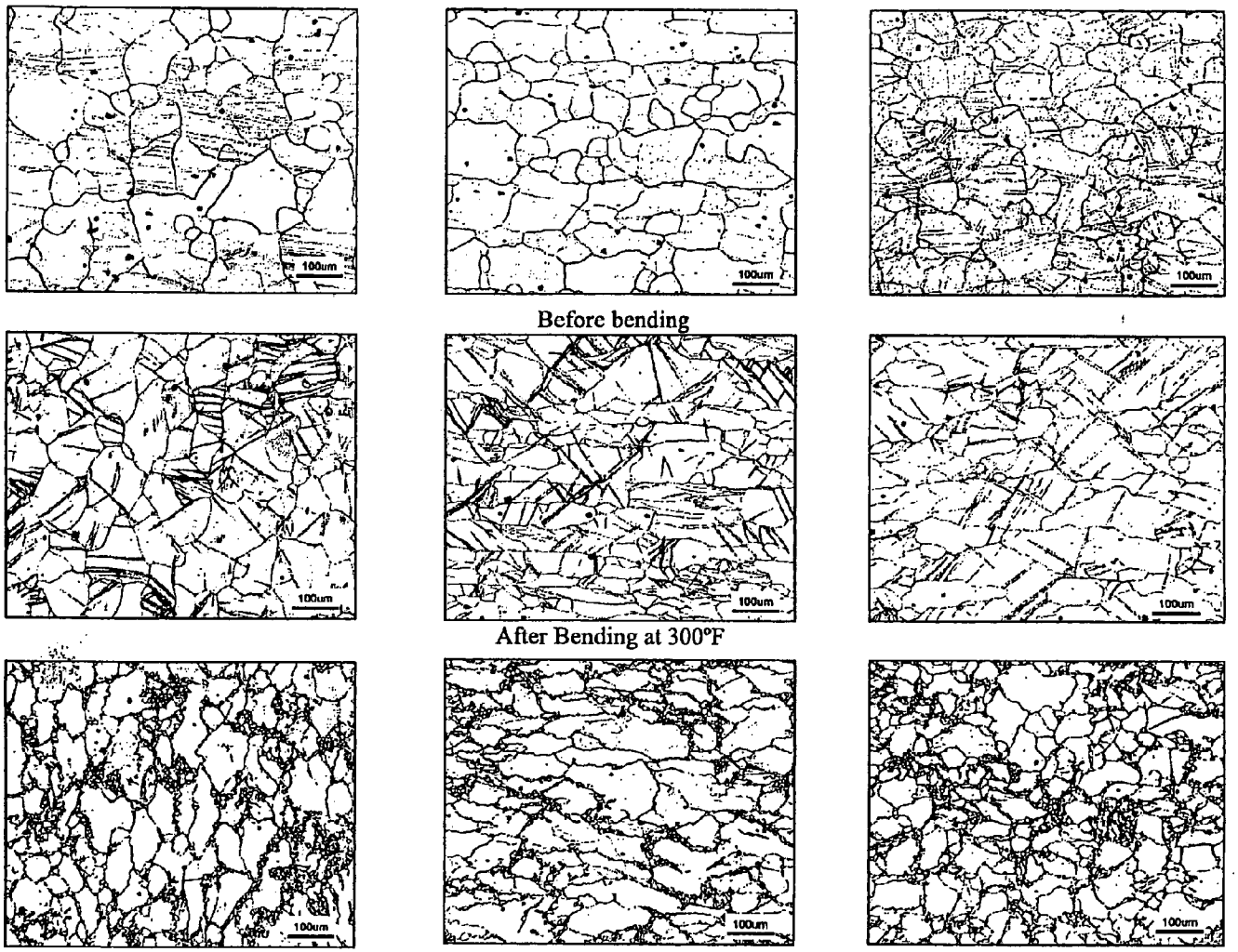
FIG. 14 is a set of optical micrographs showing the microstructure of AZ31B tubes before and after bending according to the present teachings.
Figure 15:
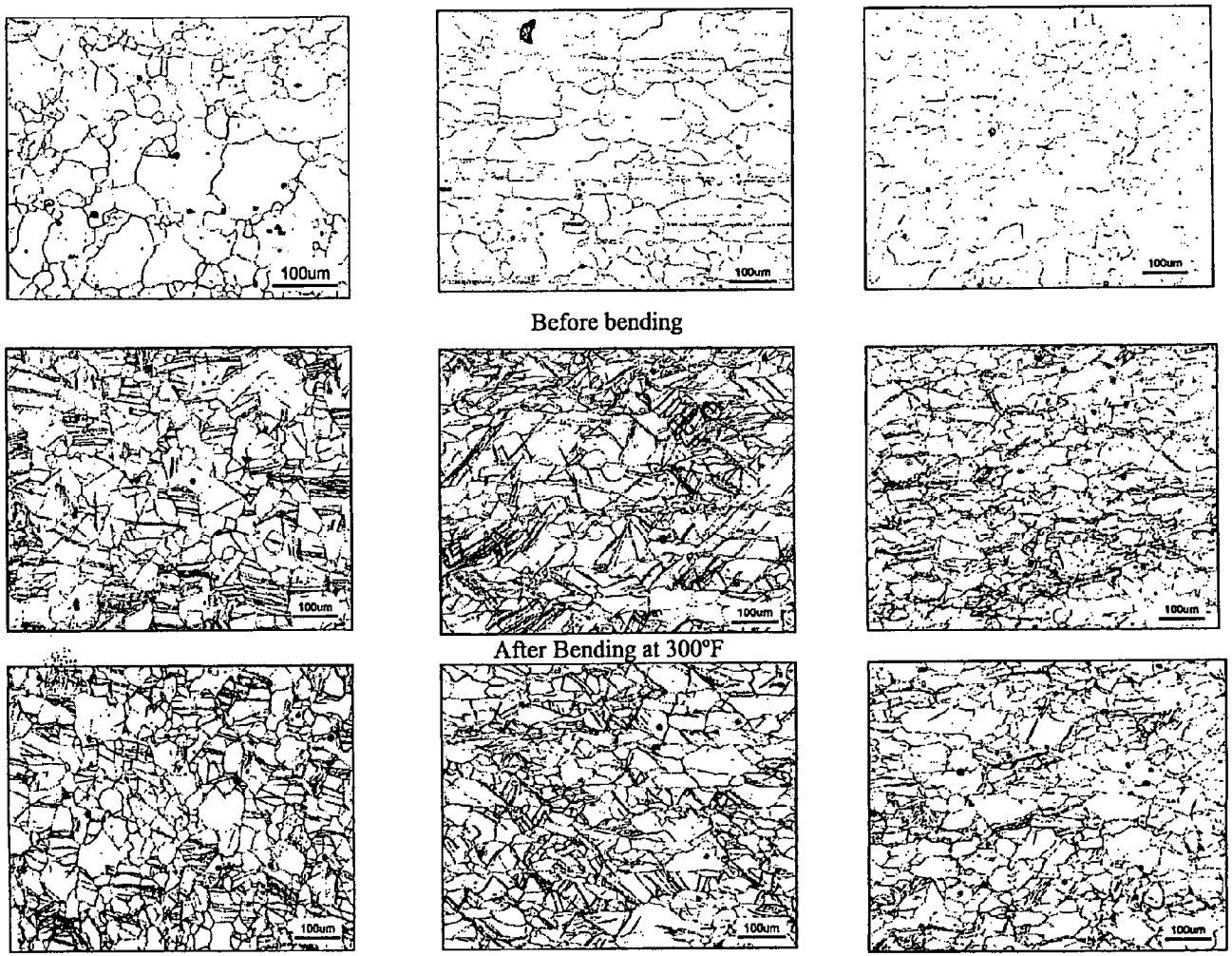
FIG. 15 is a set of optical micrographs showing the microstructure of AM30 tubes before and after bending according to the present teachings.

FIGS. 14 and 15 exhibit the grain structures of AZ31B and AM30 alloy tubes, respectively. For AZ31B alloy tubes, a certain degree of twinning was observed on the surface and transverse section of the tubes before bending (FIG. 14). FIG. 14 also shows that bending deformation at 300° F. (149° C.) was achieved by more twinning, especially in the longitudinal section, where large grains are elongated along the bend direction. However, twinning is absent in the microstructure after 400° F. (204° C.) bending, where deformation was accompanied by localized dynamic recrystallization (DRX), i.e. formation of new strain-free grains (2–3 μm in diameter) along the original high-angle grain boundaries.

For the AM30 alloy (FIG. 15), twinning was essentially absent in the tube microstructure before bending, but extensive twinning was evident after bending at 300° F. (149° C.). However, unlike AZ31B alloy, no local DRX was observed in the AM30 tubes after bending at 400° F. (204° C.), and bending deformation for AM30 alloy was still achieved by twinning.

According to the present teachings, the moderate temperature bending method for magnesium alloy tubes 102 provides a convenient and cost efficient working process for such tubes 102. As such, the present teachings enable the use of magnesium alloy tubes in many applications, including, but not limited to, automotive interior and structural components, such as, for example, instrument panel beams, seat and window/sunroof frames, roof bows, engine cradles, subframes, etc, resulting in significant vehicle weight reduction.

Although exemplary results are presented for rotary drawing of magnesium alloy tubes 102, the present teachings are not limited to rotary drawing. Moderate temperature working can be equally applied to hydroforming and other forming processes of magnesium alloy tubes 102. Therefore, the present teachings contemplate heating a magnesium alloy tube 102 at a moderate temperature and forming the tube 102 to a desired shape. Similarly, although results for two exemplary magnesium alloys, AM30 and AM31 are presented, the present teachings are applicable to other magnesium alloys. Bend angles, bend radii and other dimensions of the tubes 102, as well as various experimental set-up characteristics, such as lubricants, use of wiper dies 114, etc, are merely exemplary and are not intended as limitations of the present teachings.

The description of the invention is merely exemplary in nature and, thus, variations that do not depart from the gist of the invention are intended to be within the scope of the invention. Such variations are not to be regarded as a departure from the spirit and scope of the invention.

What is claimed is:

1. A method for bending a magnesium alloy tube, the method comprising:

heating the tube at a moderate temperature in the range of about 100° C. to 200° C.; and bending the tube to a bend angle, wherein said bending at said moderate temperature range provides a bend quality having one or more properties selected from the group consisting of: a maximum surface defect variance of less than or equal to about 5, a maximum % thinning variance of less than or equal to about 42, a standard deviation of % thinning of less than or equal to about 8.5, and combinations thereof.

2. The method of claim 1, wherein heating the tube comprises:

heating a tooling; and holding the tube in the tooling until it is heated to the moderate temperature.

3. The method of claim 1, further comprising placing the tube over a mandrel.

4. The method of claim 3, wherein bending the tube comprises:

positioning the tube between a pressure die and a bend die;

applying pressure with the pressure die; and rotating the bend die.

5. The method of claim 1, wherein bending the tube comprises bending the tube to a bend radius that is at least twice an outside diameter of the tube.

6. The method of claim 1, wherein bending the tube comprises bending the tube to a bend radius that is less than twice an outside diameter of the tube.

7. The method of claim 5, wherein the bend angle is 90°.

8. The method of claim 7, wherein the magnesium alloy is AM30.

9. The method of claim 7, wherein the magnesium alloy is AZ31B.

10. The method of claim 1, wherein the moderate temperature is in the range of about 125° C. to 175° C.

11. The method of claim 1, wherein the moderate temperature is about 150° C.

12. The method of claim 2, further comprising holding the tube in the tooling for about one minute before bending.

13. The method of claim 2, further comprising holding the tube in the tooling for about five minutes before bending.

14. The method of claim 2, wherein the tooling comprises a mandrel, a pressure die and a bend die.

15. The method of claim 1, further comprising lubricating the tube.

16. The method of claim 1, wherein bending comprises bending by rotary draw.

17. The method of claim 1, wherein bending comprises hydroforming.

18. The method of claim 1, wherein bending comprises compression bending.

19. The method of claim 1, wherein bending comprises roll bending.

20. The method of claim 1, wherein the magnesium alloy comprises over 80% magnesium.

21. A magnesium alloy tube bent by the method of claim 1.

22. A method for forming a magnesium alloy tube, the method comprising:

heating the tube at a moderate temperature in the range of about 100° C. to 200°; and forming the tube to a desired shape, wherein said forming at said moderate temperature range provides a bend quality having a maximum surface defect variance of less than or equal to about 5.

23. The method of claim 21, wherein forming includes bending at a bend angle.

* * * * *